US007045053B2

(12) United States Patent
Matzka et al.

(10) Patent No.: US 7,045,053 B2
(45) Date of Patent: May 16, 2006

(54) PROCESS AND APPARATUS FOR THE SUPERFICIAL ELECTROLYTIC TREATMENT OF METAL STRIPS

(75) Inventors: Ralf Matzka, Moers (DE); Dieter Gruchot, Bochum (DE)

(73) Assignee: Danieli & C.Officine Meccaniche S.p.A., Buttrio (IT)

( * ) Notice: Subject to any disclaimer, the term of this patent is extended or adjusted under 35 U.S.C. 154(b) by 576 days.

(21) Appl. No.: 10/381,150

(22) PCT Filed: Sep. 21, 2001

(86) PCT No.: PCT/EP01/10938

§ 371 (c)(1),
(2), (4) Date: Apr. 28, 2003

(87) PCT Pub. No.: WO02/24980

PCT Pub. Date: Mar. 28, 2002

(65) Prior Publication Data

US 2004/0040865 A1 Mar. 4, 2004

(51) Int. Cl.
*C25F 1/04* (2006.01)
*C25F 7/00* (2006.01)

(52) U.S. Cl. ..... 205/705; 205/712; 205/717; 204/206; 204/207; 204/208; 204/211; 204/269

(58) Field of Classification Search ..... 205/705, 205/712, 717; 204/206, 207, 208, 211, 269
See application file for complete search history.

(56) References Cited

U.S. PATENT DOCUMENTS

| | | | | |
|---|---|---|---|---|
| 2,556,017 | A | 6/1951 | Vonada | |
| 4,310,403 | A * | 1/1982 | Nitto et al. | 204/206 |
| 5,382,335 | A | 1/1995 | Jirenec et al. | |
| 5,584,984 | A * | 12/1996 | Pempera et al. | 205/704 |

FOREIGN PATENT DOCUMENTS

| | | |
|---|---|---|
| DE | 4425854 | 11/1995 |
| EP | 0695818 | 12/1996 |

* cited by examiner

*Primary Examiner*—Arun S. Phasge
(74) *Attorney, Agent, or Firm*—Sampson & Associates, P.C.

(57) ABSTRACT

An apparatus for the superficial electrolytic treatment of metal strips, comprising several separate and non-communicating tanks, or containers, located along the path of metal strip (13). A series of electrodes in pairs (14', 15', 14", 15", 14'", 15'"), arranged as tunnels, is situated along the path. Each pair is associated with a container (2', 2", 2'"), in which an electrod 14', 14", 14'") of each pair is located above the strip and the other (15', 15", 15'") is located below said strip, in a reciprocally opposits position and at an appropriate distance. The electrode pairs alternately have opposite polarity and each of them is respectively associated with a container. Rollers (3, 3', 3", 3'") in pairs for strip pressing are situated at the common border of adjacent containes for the galvanic separation of the strip surface areas facing the electrode pairs of opposite polarity.

7 Claims, 2 Drawing Sheets

PROCESS AND APPARATUS FOR THE SUPERFICIAL ELECTROLYTIC TREATMENT OF METAL STRIPS

FIELD OF THE INVENTION

The present invention refers to a process for the superficial electrolytic treatment of metal strips, in particular of stainless steel, and to the relevant apparatus.

STATE OF THE ART

Apparatuses for surface treatment are particularly useful for cleaning and removing oil, grease, scales or other contaminants from metal strips prior to their storage or in preparation for further treatments, such as plastic deformation or plastic and metal coating or the like.

European patent application EP-A-695.818 describes an apparatus for the superficial electrolytic treatment of metal strips. The strips to be treated pass through a container which contains an electrolyte and is provided with electrodes in pairs situated above and below the strip path. The electrodes are lined up and a pair of anodic electrodes alternates with a pair of cathodic electrodes. The electrolyte is sprayed on the strip through a plurality of nozzle pairs, each associated with a respective pair of electrodes. Furthermore, the nozzle pairs separate the cathodic electrodes from the anodic ones. A drawback of this apparatus is that, at a low strip feed rate, the electrolyte adheres to the strip surface. Furthermore, the metallic hydroxide produced by pickling in the anodic electrodes area only, mixes with the whole electrolyte.

SUMMARY OF THE INVENTION

It is a major object of the present invention to make up for the aforesaid drawbacks, by providing an apparatus for the superficial electrolytic treatment of metal strips that achieves an optimal superficial treatment of the same, by a low energy consumption, and by an improved capability of separating the metallic hydroxide generated during the electrolytic acid cleaning.

It is a further major object of the present invention to provide a process for the superficial electrolytic treatment of metal strips, using the aforesaid apparatus, capable of achieving an optimal dissolution of oxides and removal of hydroxide residues from the containers.

The aforementioned objects as well as other objects, that will be apparent from the description hereafter, are achieved, as claimed in claim 1, by an apparatus for the superficial electrolytic treatment of metal strips, which comprises a plurality of separated and non-communicating containers, internally defining a longitudinal feed path of metal strip; a plurality of electrode pairs situated along said path, whereby each electrode pair is associated with one of said containers, the first electrode of each electrode pair being located above said metal strip and the respective second electrode of said each electrode pair being located below said metal strip, in a reciprocally opposite position and at a predetermined distance from said metal strip, each of said electrode pairs having polarity opposite to that of the adjacent electrode pair, and being associated, respectively, with one of said containers characterised in that there is provided at least one pair of pressure rollers for strip pressing situated in each area between adjacent containers for galvanic separation of the strip surface areas facing the electrode pairs of opposite polarity and in that said electrode pairs form a tunnel around the metal strip path. Thanks to the aforesaid features, the plurality of containers, in which the various electrolytic steps take place, are clearly separated one from the other. The electrolyte used in each container for metal strip treatment keeps separated from the electrolyte of the other containers. Also the strip surface areas facing the anodic electrodes are separated from the strip surface areas facing the cathodic electrodes in a more effective manner by means of the pair of rollers at the border of adjacent containers. It is thus possible to remove and collect the two electrolyte mixtures leaving the containers by separate hydraulic systems and filter only the electrolyte of the containers associated with the electrode tunnels of anodic polarity, in which metallic hydroxide is produced. In a successive step, if required, the electrolyte leaving both hydraulic systems may be mixed again.

Additionally the electrode pairs of the apparatus for the superficial electrolytic treatment of metal strips form a tunnel around the metal strip feed path. This particular arrangement of the electrodes has the considerable advantage that a higher turbulence is produced in the electrolyte flow. The turbulence increases the mass transfer between metal strip and electrolyte. Thanks to the faster ion exchange, the reaction time of the pH-value variation of the metal strip surface during polarisation variation is shorter. Globally the apparatus achieves an optimised dissolution of the oxidised chromium layer and removal of the hydroxide residues out of the pickling container.

In a preferred embodiment of the invention, each electrode pair is provided at both ends with nozzles in pairs adapted for spraying the electrolyte on said metal strip, with primary and secondary flow spraying in a direction opposite to each other. This feature further improves the separation effect between two adjacent containers.

It is a further object of the present invention to provide a process for the superficial electrolytic treatment of metal strips which, as claimed in claim 7, comprises the steps of:

a) conveying the metal strip to be treated electrolytically along the path defined by said electrode pairs,
b) electrically feeding said electrode pairs with polarities respectively suitable for alternately obtaining anodic and cathodic pairs along the strip path,
c) spraying the electrolyte on the two opposite sides of said metal strip through nozzles, with a primary fluid spraying in the direction of the strip travel and a secondary fluid spraying in the opposite direction,
d) applying a superficial pressure on said strip by means of roller pairs situated in between two adjacent containers, to produce the galvanic separation of the electrodes,
e) conveying the strip along all the electrode tunnels of the apparatus,
f) pulling out the strip from the apparatus,
g) placing the strip in a storage area or in another apparatus for further treatment.

BRIEF DESCRIPTION OF THE DRAWINGS

Further advantages and aspects of the invention will become apparent from the detailed description of preferred, non limitative, embodiments of an apparatus for the superficial electrolytic treatment of metal strips, hereafter shown by way of non-limitative example by means of the accompanying drawings.

DETAILED DESCRIPTION

Figure 1:
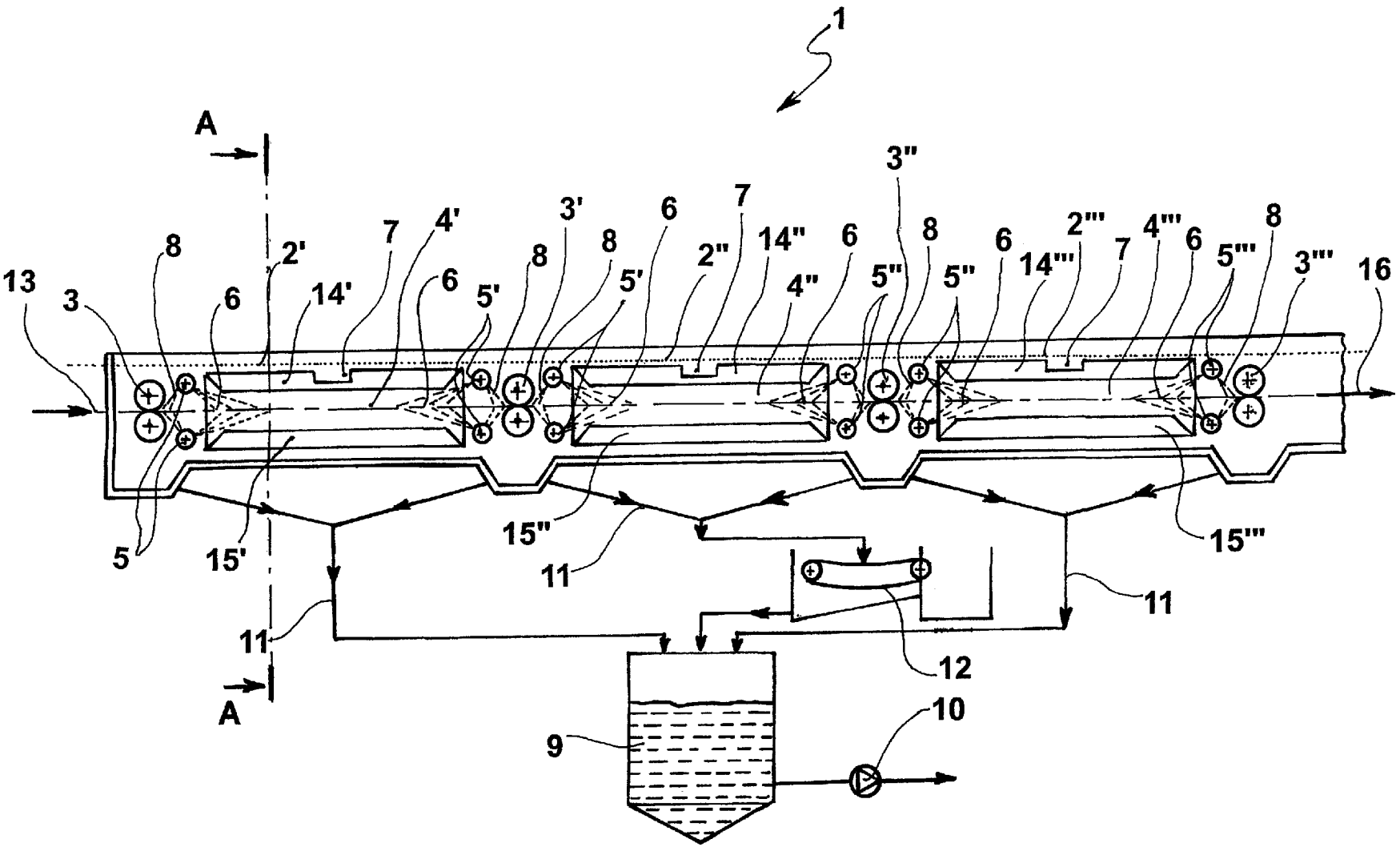
FIG. 1 shows a schematic sectional view, along a longitudinal vertical plane of the apparatus for the superficial electrolytic treatment of metal strips according to the invention.

With reference to the Figures, the apparatus for the superficial electrolytic treatment of metal strips includes a plurality of containers 2. In the present embodiment the envisaged containers are three; however, other embodiments may envisage a lower or higher number of containers. A particularly advantageous embodiments provides for six containers forming one unit. A metal strip 13, e.g. of stainless steel, travels along a horizontal straight path, in the direction of arrow 16, in a central position inside a plurality of consecutive tunnels 4, consisting of electrode pairs 14', 15', 14", 15", 14''', 15'''.

Each tunnel consists of electrode pairs having polarity opposite to that of the adjacent electrode pair, i.e. should electrode pair 14', 15' have cathodic polarity, the adjacent electrode pair 14", 15" will have anodic polarity and the successive adjacent electrode pair 14''', 15''' will have cathodic polarity, and so forth for the whole apparatus length. In an alternative embodiment of the invention, a series of electrodes ending with a cathodic pair may be followed by a series of electrodes pairs with cathodic polarity.

Tubes, or bars, in pairs 5, 5', 5", 5''' provided with nozzles are situated at the respective entrance to and exit from each tunnel. The first bar of each pair is located above the strip surface and the second bar is located below the strip surface at an appropriate distance. The nozzles fitted to each bar are positioned in such a way as to spray the electrolyte on the strip surface in two opposite directions in respect of the bar axis and with fluid flows 6 and 8 of different intensity. Primary fluid flow 6 is sprayed inside the respective tunnel, while secondary fluid flow 8 is directed on the strip outside the tunnel. The function of fluid flow 6 is to fill the tunnel it is associated with and, at the same time, remove gas blisters produced during the electrolytic process and eliminate them from containers 2', 2", 2''' through overflow 7. The function of secondary fluid flow 8 is to maintain the metal strip wet when passing from one tunnel to the next one. At the same time, it reduces the metal strip electric resistance.

The hydraulic system includes manifolds 11 for liquid recycle, filter 12, tank 9 and pump 10 to feed the system with the electrolyte. Filter 12 filters the liquid drawn from container 2", which, in the present embodiment of the invention, is associated with the tunnel of electrodes 4" of anodic polarity, whereby metallic hydroxide is produced. At least a pair of rollers 3, 3', 3", 3''', is located at each end of each tunnel. The rollers press the metal strip surface and act as galvanic separators for the electrodes, by separating each container from the adjacent one.

In the present embodiment of the invention, the metallic hydroxide generated in the anodic electrodes area is removed only from said area, which results in a greater effectiveness of the whole apparatus because a higher hydroxide concentration allows an improved subsequent separation. In the apparatus, each tunnel formed by anodic electrodes is fed through two electric rectifiers (not shown in the Figure). The first rectifier is connected to the preceding adjacent tunnel along the strip path, which consists of cathodic electrodes, and the second rectifier is connected to the successive adjacent tunnel along the strip path, which consists of cathode electrodes.

Figure 2:
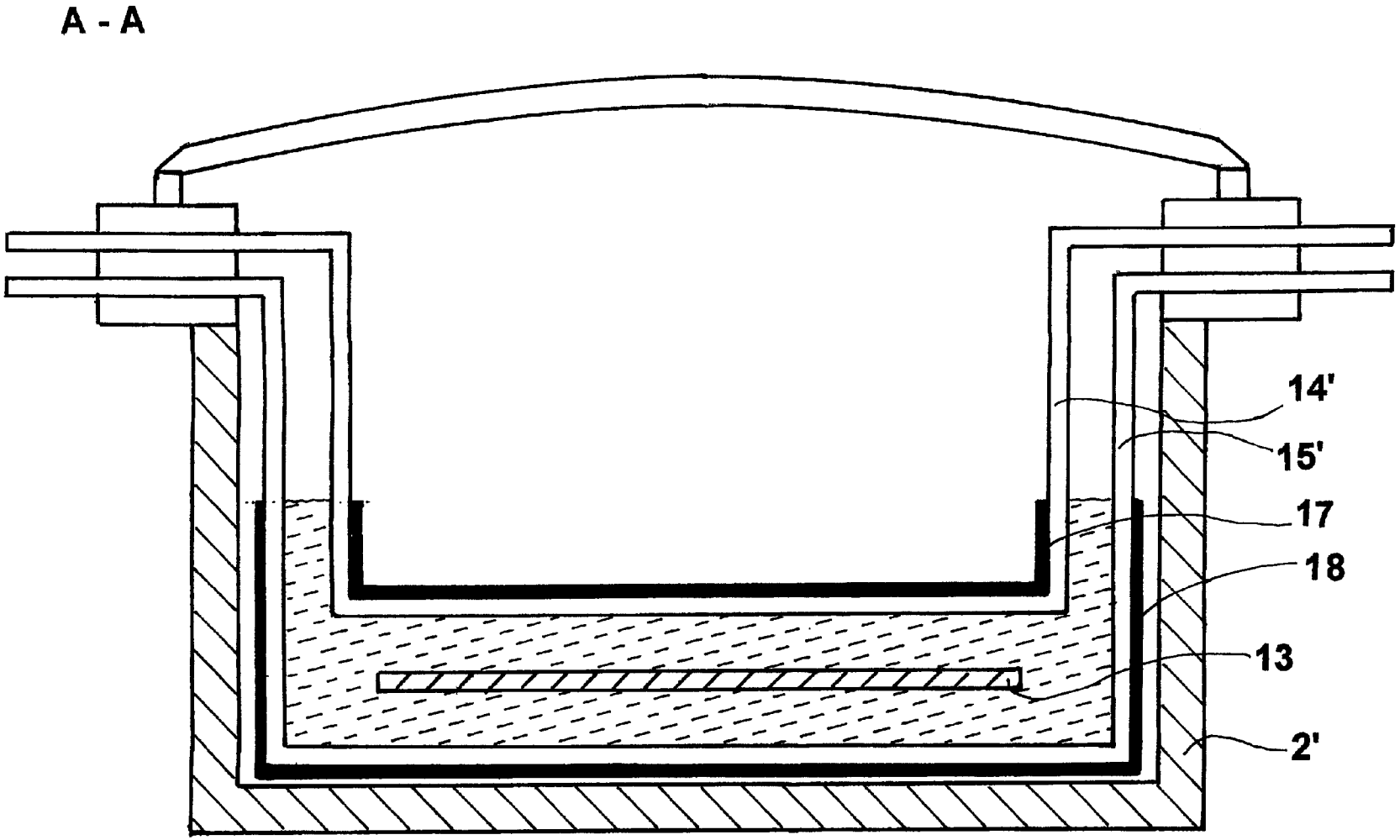
FIG. 2 shows a sectional view of the apparatus of FIG. 1 along line A—A.

More details of the apparatus are shown in FIG. 2, in which the container 2' is provided with a cover that can be opened for access to the inside of the container. The tunnel is formed by two continuous elongated plates 17, 18 of dielectric material, e.g. plastic material, to which are fixed the electrodes 14' and 15', and all other electrode pairs of the apparatus, not shown in this figure. The elongated plates 17, 18 have also a function of containment of the electrolyte fluid in which the metal strip 13 moves.

By means of the described apparatus of the invention, it is possible to carry out a novel process for the superficial electrolytic treatment of metal strips, which consists of the steps described below.

For an electrolytic treatment, e.g. electrolytic pickling in an acid environment or the like, a metal strip, e.g. of stainless steel, is inserted in the apparatus of the invention from the left side (cf. the Figure). The strip is pulled along the path between electrode pairs 14',15', 14",15", 14''', 15'''.

By actuating an electric circuit (not shown in the Figure) said electrode pairs are electrically fed and excited with polarity suitable for alternately obtaining cathodic and anodic pairs along the path of metal strip 13.

At the end of each electrode pair, or tunnel, i.e. at the tunnel entrance or exit, the electrolyte is sprayed on the two opposite sides of the metal strip through nozzles, with primary fluid 6 spraying in the direction of the strip travel and secondary fluid 8 in the opposite direction.

During its travel along the path, the strip is pressed by rollers in pairs 3', 3", 3''', situated in between adjacent containers, for the galvanic separation of electrodes. The strip is caused to pass through all electrode tunnels and pulled out from the apparatus to be stored or inserted in another apparatus for further treatments. The process may advantageously include further steps, e.g. the metallic hydroxide removal from the electrolyte at the anodic electrodes and the electrolyte recycle.

The invention claimed is:

1. Apparatus for the superficial electrolytic treatment of metal strips comprising a plurality of separated and non communicating containers internally defining a longitudinal feed path of metal strip (13), a plurality of electrode pairs (14', 15' 14", 15", 14''', 15''') situated along said path, whereby each electrode is associated with one of said containers (2', 2", 2''') the first electrode (14'; 14"; 14''') of each electrode pair r being located above said metal strip and the respective second electrode (15', 15", 15''') of said electrode pair being located below said metal strip (13) in a reciprocally opposite position and at a predetermined distance from said metal strip (13), each of said electrode pairs having polarity opposite to that of the adjacent pair and being associated respectively with one of said containers (2', 2", 2") characterised in that a) there is provided at least one pair of pressure rollers (3', 3", 3''') for strip pressing situated in each area between adjacent containers for galvanic separation of the strip surface areas facing the electrodes pairs of opposite polarity, b) said electrodes pairs (4', 4", 4''') form a tunnel around the metal strip path producing a high turbulence in the electrolyte flow", c) each electrode pair is provided at both ends with nozzles in pairs (5, 5', 5", 5''') for spraying the electrolyte on said metal strip.

2. The apparatus as claimed in claim 1, wherein each electrode pair is provided at both ends with nozzles in pairs (5, 5', 5", 5''') fit for spraying the electrolyte on said metal strip, with primary fluid flow (6).

3. The apparatus as claimed in claim 2, wherein said nozzles partly spray the electrolyte on the strip surface with secondary fluid (8) spraying in a direction opposite to that of primary fluid flow (6).

4. The apparatus as claimed in claim 3, wherein said containers (2', 2", 2'") are filled with electrolyte up to a predetermined level corresponding to overflow (7).

5. The apparatus as claimed in claim 2, wherein each tunnel of anodic electrodes is fed by two electric rectifiers, the first connected to the preceding tunnel of cathodic electrodes, and the second to the successive tunnel of cathodic electrodes, in respect of the strip travel direction.

6. Process for the superficial electrolytic treatment of metal strips using the apparatus as claimed in claim 1, comprising the steps of:

a) conveying the metal strip to be treated electrolytically along the path defined by said electrode pairs (14', 15', 14", 15", 14'", 15'"), b) electrically feeding said electrode pairs (14', 15', 14", 15", 14'",15'") with polarities respectively suitable for alternately obtaining anodic and cathodic pairs along said strip path (13), c) spraying the electrolyte on the two opposite sides of said metal strip, through nozzles with primary fluid (6) spraying in the direction of the strip travel and with secondary fluid (8) spraying in the opposite direction, d) at the same time applying a superficial pressure on said strip by means of roller pairs (3, 3', 3", 3'") situated in between two adjacent containers, for galvanic separation of electrodes, e) conveying the strip between all electrode pairs of the apparatus, f) pulling out the strip from the apparatus, g) placing the strip in a storage area or in another apparatus for further treatment.

7. The process as claimed in claim 6, which comprises the further step of metallic hydroxide removal from the electrolyte at the anodic electrodes.

* * * * *